United States Patent [19]

Schiffman

[11] 4,026,019

[45] May 31, 1977

[54] FLEXIBLE SHOCK ABSORBING PIPE

[76] Inventor: Byron Schiffman, 760 Lillian Way, Los Angeles, Calif. 90028

[22] Filed: Aug. 30, 1973

[21] Appl. No.: 393,046

[52] U.S. Cl. ..... 131/225

[51] Int. Cl.[2] ..... A24F 5/00; A24F 7/02

[58] Field of Search ..... 131/171, 182, 192, 225

[56] References Cited

UNITED STATES PATENTS

| | | | |
|---|---|---|---|
| 1,594,606 | 8/1926 | Clivio | 131/225 UX |
| 1,971,567 | 8/1934 | Kanter | 131/225 UX |
| 2,232,092 | 2/1941 | Bellin | 131/225 |
| 2,716,413 | 8/1955 | Johnston | 131/225 X |
| 3,079,927 | 3/1963 | Fassbender | 131/225 X |
| 3,504,438 | 4/1970 | Wittman et al. | 32/14 A |

FOREIGN PATENTS OR APPLICATIONS

| | | | |
|---|---|---|---|
| 63,886 | 8/1892 | Germany | 131/171 R |
| 1,025,768 | 1/1953 | France | 131/192 |

OTHER PUBLICATIONS

"An Evaluation of 55 Cobalt Substituted Nitinol Wire for Use in Orthodontics"— *Jada*, vol. 82, June, 1971, pp. 1373–1375.

*Primary Examiner*—Stephen C. Pellegrino
*Attorney, Agent, or Firm*—Wills, Green & Mueth

[57] ABSTRACT

A novel and improved smoking pipe having a bowl for receiving tobacco, an extension extending from the base of the bowl, and a mouthpiece through which smoke may be drawn being carried by said extension; the improvement wherein said pipe has a flexible, shock-absorbing stem system comprising a cylinder within said extension, a piston connecting said stem to said extension, one end of said piston being received and reciprocatable from forward to rearward position within said cylinder and the other end forming a socket joint with said stem, a spring around said piston which normally biases the stem and piston to the rearward position within said piston, said stem being rotatable around said joint and said stem being advanceable toward said bowl when a force sufficient to overcome said spring bias is applied to said stem.

5 Claims, 6 Drawing Figures

FLEXIBLE SHOCK ABSORBING PIPE

BACKGROUND OF THE INVENTION

Various types of smoking pipes are known. For example, U.S. Pat. No. 165,002 disclosed a hinged stem. U.S. Pat. No. 796,408 relates to an adjustable pipe. Lerch U.S. Pat. No. 1,921,530 discloses a flexible nonbreakable pipe stem joint. A flexible attachment for smoking pipes is described in U.S. Pat. No. 1,971,567. U.S. Pat. No. 2,134,197 discloses a flexible stem for a smoking pipe. Another type of resilient pipe stem is described in U.S. Pat. No. 2,583,900. None of the devices of the prior art are entirely satisfactory in providing a pipe with a stem that is rotatable and reciprocatable with reference to the bowl. The present invention provides for such flexibility and reduces the possibility to damage to the teeth as well as the pipe in the event the pipe is accidently bumped when being gripped between the jaws. The pipe stem can also be deliberately reciprocated to aid in cleaning the pipe and keeping the passage for smoke free of excessive tar.

SUMMARY OF THE INVENTION

Briefly, my invention comprises a novel and improved smoking pipe having a bowl for receiving tobacco, an extension extending from the base of the bowl, and the mouthpiece through which smoke may be drawn being carried by said extension; the improvement wherein said pipe has a flexible, shock-absorbing stem system comprising a cylinder within said extension, a piston connecting said stem to said extension, one end of said piston being received and reciprocatable from forward to rearward position within said cylinder and the other end forming a socket joint with said stem, a spring around said piston which normally biases the stem and piston to the rearward position within said piston, said stem being rotatable around said joint and said stem being advanceable toward said bowl when a force sufficient to overcome said spring bias is applied to said stem.

It is an object of this invention to provide a novel smoking pipe.

It is another object of this invention to provide a pipe which will withstand impact without damages to the somker or to the pipe.

Yet another object of my invention is a pipe having a rotatable and reciprocatable stem.

Still another object of my invention is a smoking pipe which can be easily cleared of excess tars and similar material.

These and other objects and advantages of this invention will be apparent from the following description taken in conjunction with the accompanying drawings.

DESCRIPTION OF THE PREFERRED EMBODIMENTS

Turning to the drawings.

Figure 1:
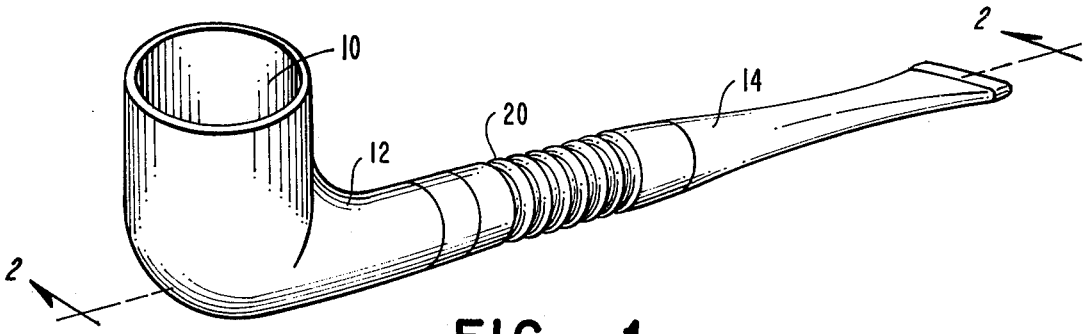
FIG. 1 is a perspective view of an embodiment of this invention.
Figure 2:
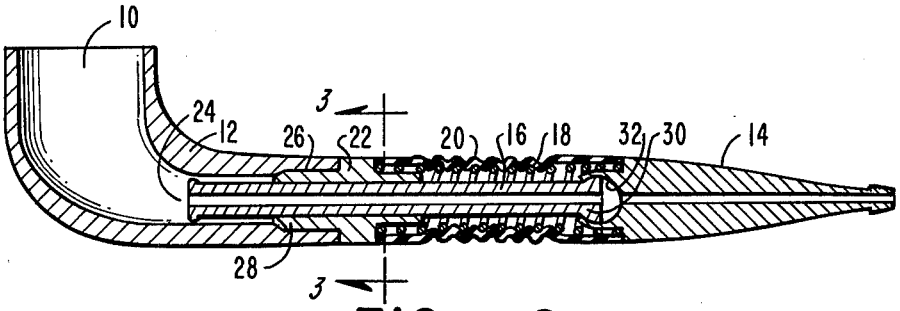
FIG. 2 is a side sectional view of one embodiment of my invention.

In FIG. 1, the pipe bowl 10 has an integral extension 12 and a stem 14. The stem 14 is connected to the extension 12 by the piston 16, surrounding coil spring 18, and exterior, flexible, compressible, corrogated rubber covering 20. The piston 16 is snuggly and slidably received in cylinder 22 so that when the spring 18 is compressed, the piston 16 is advanced in cylinder 22, as shown in FIG. 2. This advancement aids in clearing passage 24 of tar and other similar materials. The exterior 26 of projection 28 on cylinder 22 is received in extension 12 with a press or slight interference fit. The piston 16 can be provided with a ball 30 receivable in socket 32 of stem 14 as shown in FIG. 2.

Figure 4:
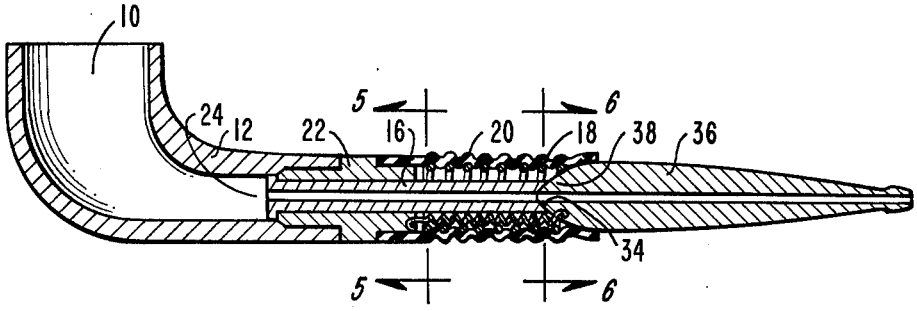
FIG. 4 is a side sectional view of another embodiment of the present invention.
Figure 3:
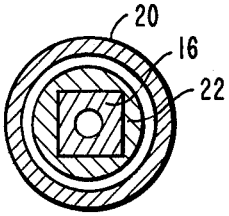
FIG. 3 is a sectional view taken along the line 3—3 in FIG. 2.
Figure 5:
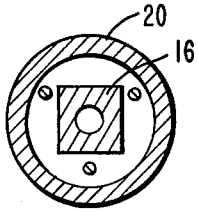
FIG. 5 is a sectional view taken along the line 5—5 in FIG. 4.
Figure 6:
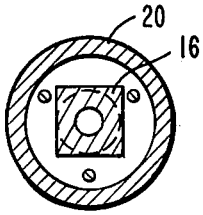
FIG. 6 is a sectional view taken along the line 6—6 in FIG. 4.

Alternatively, the piston may be provided with a socket-like end 34 as shown in FIG. 4. In this embodiment, the stem 36 has a complementary curved head 38. In any event, the stem is joined to the piston so that the stem can be rotated up and down and left to right, or any combination thereof.

It will be apparent to those familiar with this art, that the pipe of this invention solved a long-standing problem for pipe smokers. The pipe of this invention can be used with greater safety and cleanliness. At the same time, the stem system is sufficiently rigid so that the pipe is rather conventional in appearance, and is smoked and held in the usual way.

Having fully described my invention, it is intended that it be limited only by the lawful scope of the appended claims.

I claim:

1. A novel and improved smoking pipe having a bowl for receiving tobacco, an extension from the base of the bowl, said extension having a generally centrally disposed smoke passage therein, and a stem including a mouthpiece, said stem having a passage through which smoke may be drawn from said bowl to said mouthpiece, said stem being carried by said extension; the improvement wherein said pipe has a flexible, shock-absorbing stem and extension system comprising a cylinder within said extension around said smoke passage, a piston connecting said stem to said extension, one end of said piston being received and reciprocable within said cylinder and the other end extending beyond said cylinder and forming a socket joint with said stem, a spring-like means being provided around said piston which normally biases the stem and piston away from said bowl, said stem being rotatable around said socket joint and said stem being advanceable toward said bowl when a force sufficient to overcome said spring bias is applied to said stem, and said piston being provided with a ball and said stem being provided with a complementary socket, said ball and said socket comprising said socket joint.

2. The smoking pipe of claim 1 wherein the advancement of said stem toward said bowl causes said piston to move forward in said smoke passage in said extension and aid in clearing said passage of tar and similar material.

3. The smoking pipe of claim 2 wherein said spring-like means is a coil spring.

4. The smoking pipe of claim 3 wherein said coil spring is covered by a resilient corrugated tubular member.

5. The smoking pipe of claim 4 wherein one end of said spring engages said ball of said socket joint.

* * * * *